United States Patent [19]

Beattie et al.

[11] Patent Number: 4,878,782

[45] Date of Patent: Nov. 7, 1989

[54] DRAIN CHANNEL ALIGNMENT AND INSTALLATION APPARATUS

[76] Inventors: Thomas B. Beattie, 213 Riverdale Ave., Vacaville, Calif. 95688; Fred M. Schweinberg, 15819 Lakecliffe, Houston, Tex. 77095; Ronald L. Rutzen, 238 Greenbow, Highlands, Tex. 77562

[21] Appl. No.: 132,082

[22] Filed: Dec. 11, 1987

[51] Int. Cl.[4] ..... E02B 5/00

[52] U.S. Cl. ..... 405/119; 248/49; 405/121

[58] Field of Search ..... 405/118, 119, 121, 122, 405/123; 248/48.1, 49, 58, 65, 70

[56] References Cited

U.S. PATENT DOCUMENTS 1,183,906 5/1916 Rankin et al. ..... 405/122
3,299,641 1/1967 Heagler et al. ..... 405/122 X
4,090,686 5/1978 Yarbrough ..... 248/49
4,149,710 4/1979 Rouchard ..... 248/49 X

*Primary Examiner*—David H. Corbin
*Attorney, Agent, or Firm*—Albert M. J. Finch, Jr.

[57] ABSTRACT

An alignment and installation strap for a presloped drainage channel run is disclosed wherein the strap includes a body and two arms perpendicular to said body, a spike attachment means on each arm and at least two thread holes with bolts on each arm, the holes being placed so that when the strap is placed over or under two adjacent drainage channel sections one of the bolts on each arm will screw into an indentation on each outside wall of one channel section and the other bolt on each arm will screw into an indentation on each outside wall of the second channel section when the two sections are correctly aligned and the two spike attachment means will accept, slide over and attach to two spikes which may be driven into the ground.

10 Claims, 4 Drawing Sheets

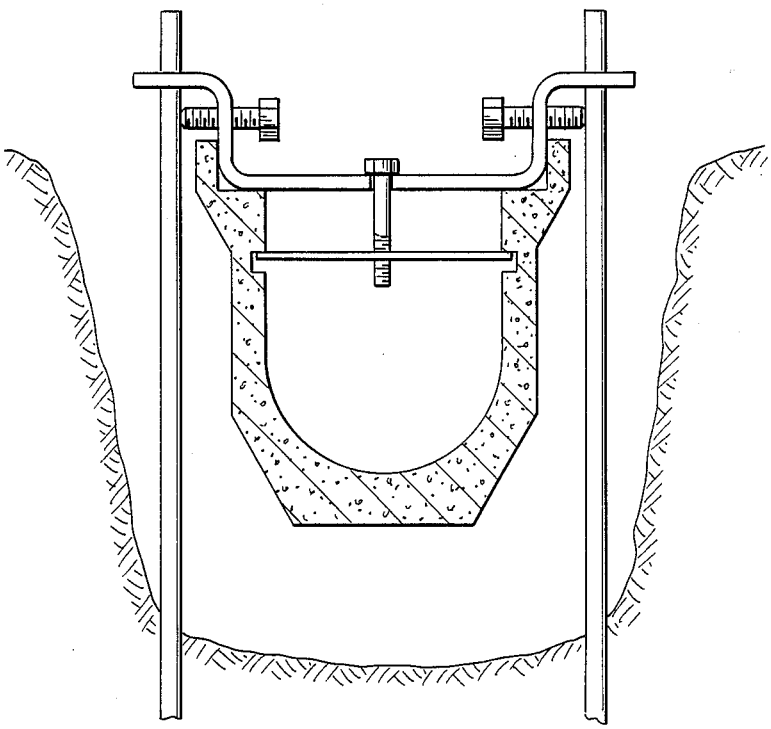
FIG. 9
(PRIOR ART)
FIG. 8
(PRIOR ART)
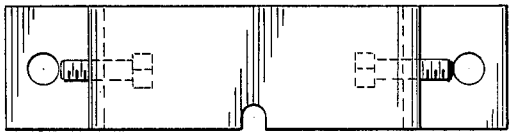
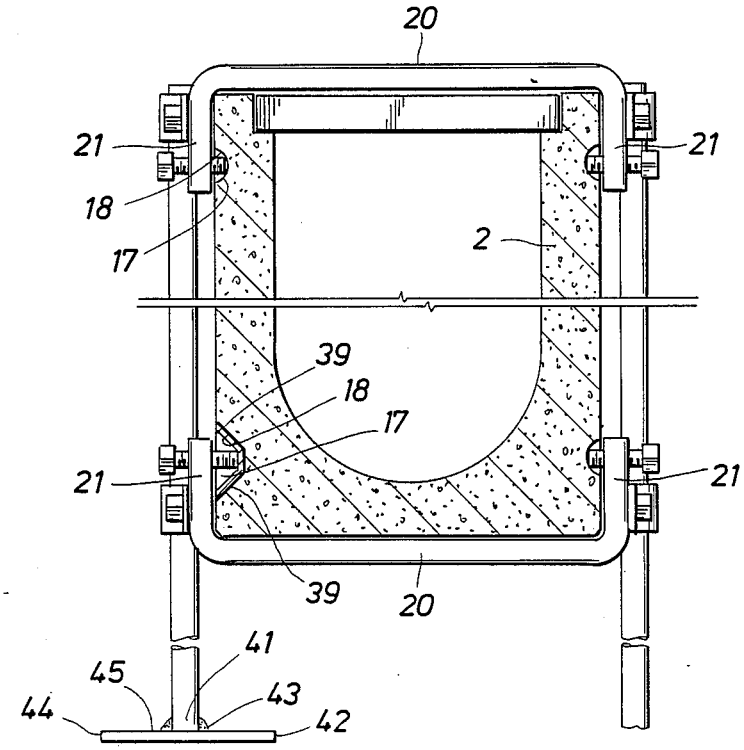
FIG. 7

DRAIN CHANNEL ALIGNMENT AND INSTALLATION APPARATUS

TECHNICAL FIELD AND BACKGROUND OF THE INVENTION

This invention relates to a drainage channel with means for maintaining proper slope during installation of the channel, and a method for installing a drainage channel in concrete. Drainage channels of the type referred to in this application are open top drainage channels which are used to drain parking lots, airports and driveways, as well as various interior fluid drainage applications. Usually a longitudinally extending grate is set into the open top of the drainage channel. Both the channel itself and the grate may be constructed of various materials and according to various processes to support light, medium or heavy loads. In the particular embodiment discussed in this application, the drainage channels are cast of "polymer concrete", a concrete aggregate material containing quartz and inert mineral fillers bonded with polyester and/or vinylester resins.

Typically, the drainage channel is cast in relatively short lengths or sections such as one meter or four feet. Each channel section has a predetermined depth and a bottom slope, for example, 0.6%, from one end to the other. A drainage channel is formed by using cast channel segments having successively higher walls so that when put in the proper order in a trench they collectively form a channel run having a predetermined slope a described above.

The top opening of the channel is usually covered with grating and is flush with or very slightly below the surface to be drained. The channel segments are embedded in concrete within a trench which must be properly prepared to receive the channel segments in proper order and with proper slope. Usually, the trench must be relatively level relative to the surface to be drained and properly graded with a level string line.

SUMMARY OF THE INVENTION

This invention relates to a drainage channel with a novel installation and alignment device that significantly eases and provides for the correct installation of the drainage channel in its intended use. The U-shaped drainage channel sections are supplied by the manufacturer with a molded presloped bottom such that when a series of tiles or channel sections are installed end to end in an excavation, a continuous smooth and presloped drainage system is provided, while the upper surface of the drain channel remains on a plane substantially equal to the finished grade level. After proper alignment in an excavation, Portland Cement concrete is poured around and under the drainage channel system up to the grade level to secure the system and to match adjoining grade level surfaces.

It is apparent that for a successful and correct installation four items must occur:

1. The top surface of the drain channel sections must be in good alignment to ensure the presloped bottoms of the contiguous channel sections are correspondingly aligned to provide a smooth surface for proper drainage flow. This also allows for a grating to fit into the channel system and also align properly.
2. The male and female interlocking mating surfaces of contiguous channel sections should fit against one another as tightly as possible, with or without caulking, to minimize seepage and leaking through the joint. As the channels are sometimes exposed to chemically aggressive liquid service, the liquids could leak through the joint and corrode the surrounding and embedding Portland Cement concrete leading to an undermining and weakening of the supporting Portland Cement concrete structure.
3. The U-shaped walls of the drain channel sections must not be forced into or deformed towards the center of the channel by the hydraulic forces created by placing Portland Cement concrete under and around the channel system. Should this occur, the grates will not fit into the channel recesses due to zero o negative clearance thereby ruining the installation.
4. The channel sections must be held down securely in the excavated area so they neither float in the wet embedding concrete nor sink from their own weight.

Existing practice in the industry includes the use of an assortment of bricks under the channel, steel reinforcing bar and tie wires, bent wire cages, and shims in an effort to correctly seat and align the presloped drainage channels.

U.S. Pat. No. 4,498,807, issued Feb. 12, 1985, discloses a drainage channel chair consisting of a seat with attached legs where the height of the seat is adjusted by adjusting the depth that the legs are placed in the ground, said chair having no ability to secure one channel section to another. FIG. 8 illustrates another prior art chair devise which attaches to the channel section via an indentation in the inside of the channel. This chair does not have the ability to secure one channel section to another nor can it be used underneath the channel section.

The present invention is directed towards economically solving at least three of the four items above with a single fixture, and, when used in one mode, will also solve all four of the items described above. Furthermore, when used at the top of the drainage channel, part of the invention is reusable.

Referring now to FIG. 1, when the alignment/anchor strap 19 is operatively engaged with co-operating alignment anchor indentations 17 formed in the drain channel sections 2 so that the strap is attached to the bottom of the channel, the problems set forth in items 1, 2 and 4 are solved.

For example, the cradle may be used so that a strap is placed under the bottom of one or two channel sections at either of the ends of the channel sections with the arms pointing upward, part of each arm overlapping the outside walls of each contiguous channel section. Spikes or legs are or have been loosely attached to the arms of the straps via a spike attachment means on each arm and the spikes driven into the ground or supported in a substantially vertical position. The arms of the strap are secured to the outside walls of a channel section by tightening a bolt located in the arm of the strap into an alignment anchor indentation which has been molded into the outside walls of the drainage channel section The channel may be resting on the body of the strap or may be supported by the bolts which attach the arms to the outside wall of the channel or on both.

The height of the channel in the trench is adjusted by sliding the strap over the spikes or legs to a position such that the channel is at the desired height (i.e. both ends of the channel sections are so adjusted) and attaching the strap to the spike via the spike attachment means. The position of the indentations in the outer wall of the channel sections are such that when the bolts in the arms of the strap are screwed into the indentations of two contiguous channel sections, the sections fit snugly together so as to align the inner slope and the top and secure one section to another.

In one embodiment of the invention, the indentations in the outside walls of a channel section have inwardly sloping walls. The placement of the bolts in the arm of the strap and the placement of the indentations are such that tightening the bolts into the indentations of contiguous sections forces the sections together in substantially perfect alignment, thus minimizing seepage and leaking.

A leg or spike attachment means is provided on each ar of the chair. For example, two bolts on either side of each strap arm may operate a strap clip wit a center deformation that is designed to cooperate with readily available bar or spike such as reinforcing steel (reba ) that is used to form the legs. The reinforcing steel bar may be placed through the loosened strap clip and the leg is then hammered into the earth preferably so that the upper end of the leg is below the top surface of the drain channel before the embedding concrete is placed. It is also possible to use stands 42 to hold the legs at a horizontal elevation in the trench instead of driving the leg into the ground. The tops of the drain channel may then be brought to proper elevation by sliding the seat over the legs whereupon the bolts on the strap clip ar tightened thus preventing the channel from sinking due to its own weight or from floating in the later placed wet cement concrete.

In the above descriptions, the strap is located under the drain channel and is not retrievable as it will be permanently cast into the embedding cement concrete.

The design of the strap with a large open space in the center of the body of the strap allows the embedding concrete to flow around and through the device and around the bolts screwed into the depressions in the channel, all of which act as additional anchors in the embedding concrete.

In another embodiment of the invention a strap 20 may be placed over the top ends of the channel section or sections with the arms pointing downward and overlapping a portion of the outer walls. In a fashion analogous with the description above, the pre-positioned bolts in the arms ar tightened into cooperating indentations which have been molded into the outer walls of the channel sections so that the seat is attached to the sections and matingly aligns the sections relative to each other. Each arm of the seat is equipped with a leg or spike attachment means. A spike i placed through the spike attachment means, the height of the channel section adjusted and the spike attachment means secured to a vertical spike.

When the installation chair is used on the top of the channel to align and install the drain system, the body of the strap may be equipped with two or more ears or tabs which project in the same direction as the arms. The position of the tabs is such that when the strap is attached to the channel section the tabs abut the inner walls of the channel sections to prevent the U-shaped channel from deforming towards the center of the channel due to the hydraulic head of the surrounding wet cement concrete and/or from the force of the automatically self-locating aligning and fitting bolts described above.

The tabs or ears can be made so that when bent down, the surface of the tab which contacts the channel ma be defined parallel to the direction of fluid flow through the channel. Alternatively, if the tab faces are perpendicular to the channel direction, they give the maximum strength to prevent the deformation of the channel sides. When the tabs or ears are made so that their face is parallel to the channel, the tabs are positioned so a to fit between the grate and the channel side and the combination of the grate and the tabs prevent deformation.

The strap when placed o top of the channel system may be subsequently recovered and reused after the embedding concrete has reached an initial set. It is common practice during installation of precast drainage channel systems to pour Portland Cement concrete under, but only partially up the outside sidewalls, and when such partial pour has reached an initial set, any temporary installation assistance device may be removed, and then the pour of the embedding concrete is completed. With the subject invention, this practice may be continued at which time after the partially filled embedding concrete has reached an initial set, the strap on top of the channel may be removed and an protruding rebar may be hammered into the ground below the top level of the drainage channel system.

When the strap is installed below the channel, the surrounding and embedding concrete ma be poured completely to the top of the channel system. To provide resistance to deformation forces at the top of the channel, the ears or tabs on the installation chair may be bent down in a manner opposite from that described above, and then the strap is placed on top of the channel such that the arms or ends are pointing upward and the downward protruding tabs or ears thus act as a gauging device to prevent deformation of the tops of the U-shaped channel sections during pouring of the embedding hydraulic concrete.

The strap may be used on top singularly, on the bottom singularly, and simultaneously at the top and bottom of a channel section. The device is designed to be used at each of the abutting ends of contiguous drain channel sections. The ends of the channel sections are the weakest areas of the channel before being embedded in concrete, and the device significantly strengthens the ends of the channel sections during the alignment and installation process and also supports the joint and provides rigidity to the joint.

Surprisingly because the installation devices are used at the ends of contiguous channels, there is a cost saving in that fewer installation devices are required via this methodology rather than other methodologies which generally employ two devices per channel section. For example, in an installation that requires five channel sections to drain an area between two catch basins, the normal practice would be to use ten installation alignment devices of another design or two per channel. With this invention, only six straps would be required i.e., one per channel section plus one extra to properly align with the catch basin. This is a significant economic savings.

The installation strap may be made of die stamped metal, but could possibly be formed from plastic or wood. When designed in metal or plastic with bent and rolled edges, high strength results at low cost. Thumbscrews may be used instead of bolts. Bolts may have square, penta or hexagonal heads for the automatically self locating aligning bolts.

BRIEF DESCRIPTION OF THE DRAWINGS

FIG. 7 is a schematic representation taken in cross section along lines 107—107 of FIG. 1, showing two straps attached to the top and bottom portions of a drainage channel section.

FIGS. 8 and 9 are illustrations of a prior art installation chair.

DESCRIPTION OF THE PREFERRED EMBODIMENT

Figure 1:
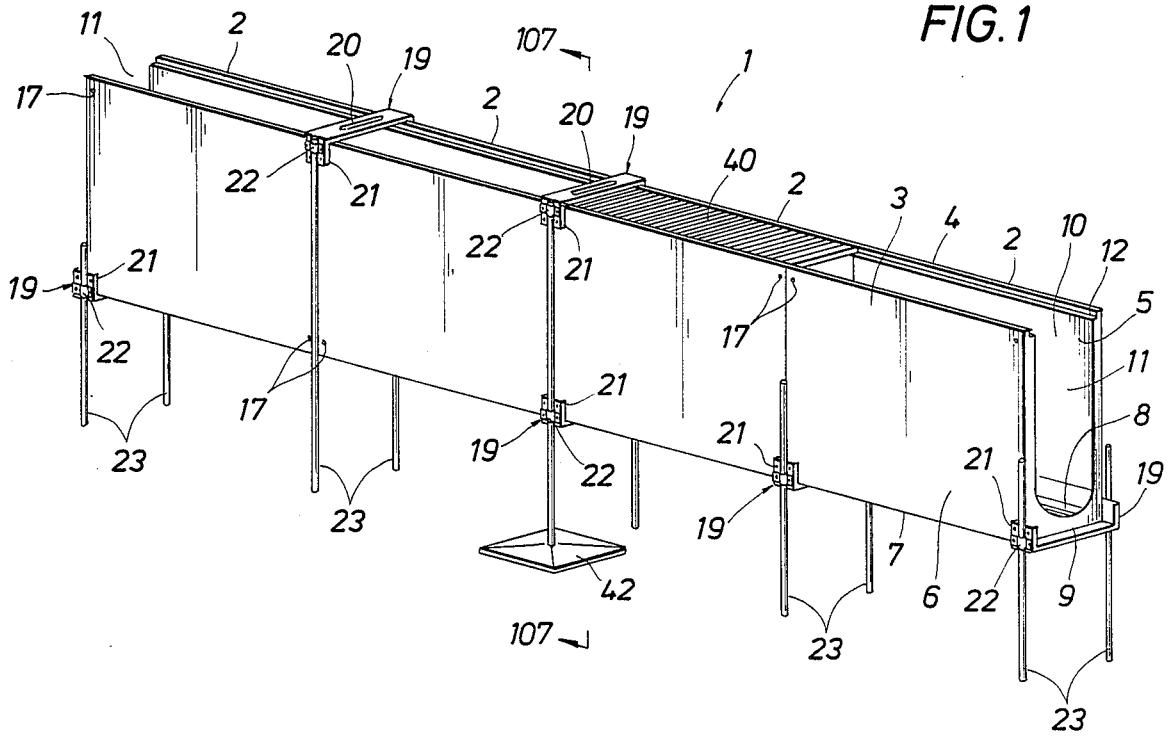
FIG. 1 is an isometric illustration of a drain channel composed of a series of drain channel sections located in a trench prior to the pouring of concrete into the trench. The sections are held at the correct level and in the correct position relative to each other by the apparatus of invention.
Figure 2:
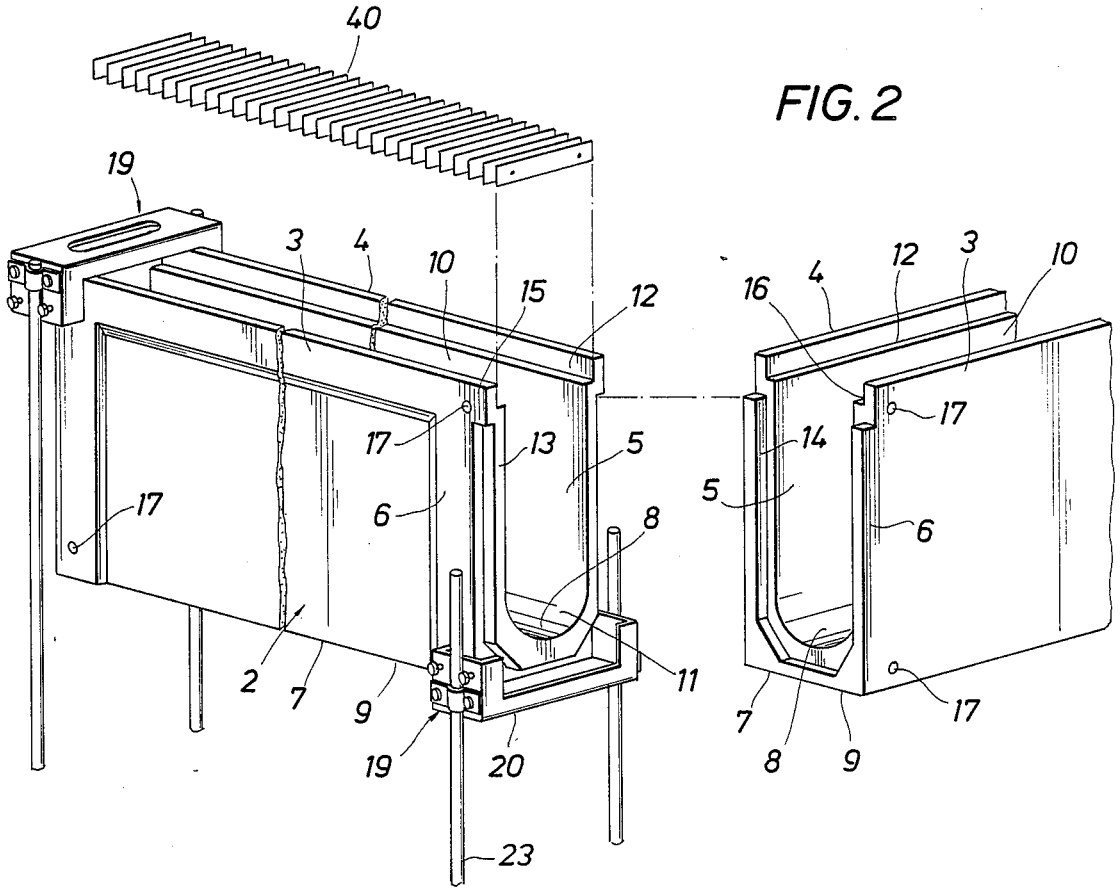
FIG. 2 is an isometric representation of a single drain channel section positioned by the legs of the apparatus and ready to receive a second channel section.

Referring now specifically to the drawings, FIG. 1 illustrates the drain channel 1 in an earthen trench ready to have the Portland Cement concrete poured into the trench to surround the drainage channel 1. The drainage channel 1 is made up of a series of drainage channel sections 2. Each drainage channel section 2 of FIGS. 1, 2, and 7 includes opposing sidewalls 3 and 4 having an inner surface 5 and outer surface 6, a bottom 7 having an inner surface 8 and outer surface 9, top opening 10 and two end openings 11. The inner surfaces 5 and 8 of the sidewalls 3 and 4 and the bottom 7 form U-shaped fluid-carrying space. The preferred drainage channel sections 2 are cast with an inner grid ridge 12 defined at the top of each sidewall 3 and 4 forming a part of the inner surface 5 so as to accept a grid cover 40 (shown in FIGS. 2 and 7) to cover the top opening 10.

The ends of the sidewalls 3 and 4 which form the two end openings 11 are made so as to abut and cooperate with the end of a second drainage channel section 2 forming one drainage channel. In a preferred embodiment (shown in FIG. 2) the ends of the sidewalls 3 and 4 are cast with miter joints 13 and 14 and 15 and 16 to help position and hold one section 2 next to a second section 2. Each section 2 has at least one alignment anchor indentation 17 on the outer surface 6 of each sidewall 3 and 4 near each of the end openings 11 (i.e. at least 4). It is preferred (shown in FIG. 7) that these indentations 17 have inwardly sloping sidewalls 18, most preferably hemispherical.

An alignment and installation strap 19, shown in FIGS. 1–7, includes a horizontal section or body 20 and two vertical end sections or arms 21. The length of the horizontal section or body 20 is slightly greater than the distance between outside surfaces 6 of the sidewalls 3 and 4 of the drainage channel section 2 so that when the strap 19 is placed over the top 10 or under the bottom 7 of the drainage channel section 2, the arms 21 extend parallel to the outer surface 6 of the sidewalls 3 and 4. Each arm 21 is equipped with a spike attachment means 22 for accepting, sliding over and attaching to a spike 23 so that the spike 23 cooperates with and can be attached to the strap 19 parallel to the arms 21 and perpendicular to the body 20.

Figure 3:
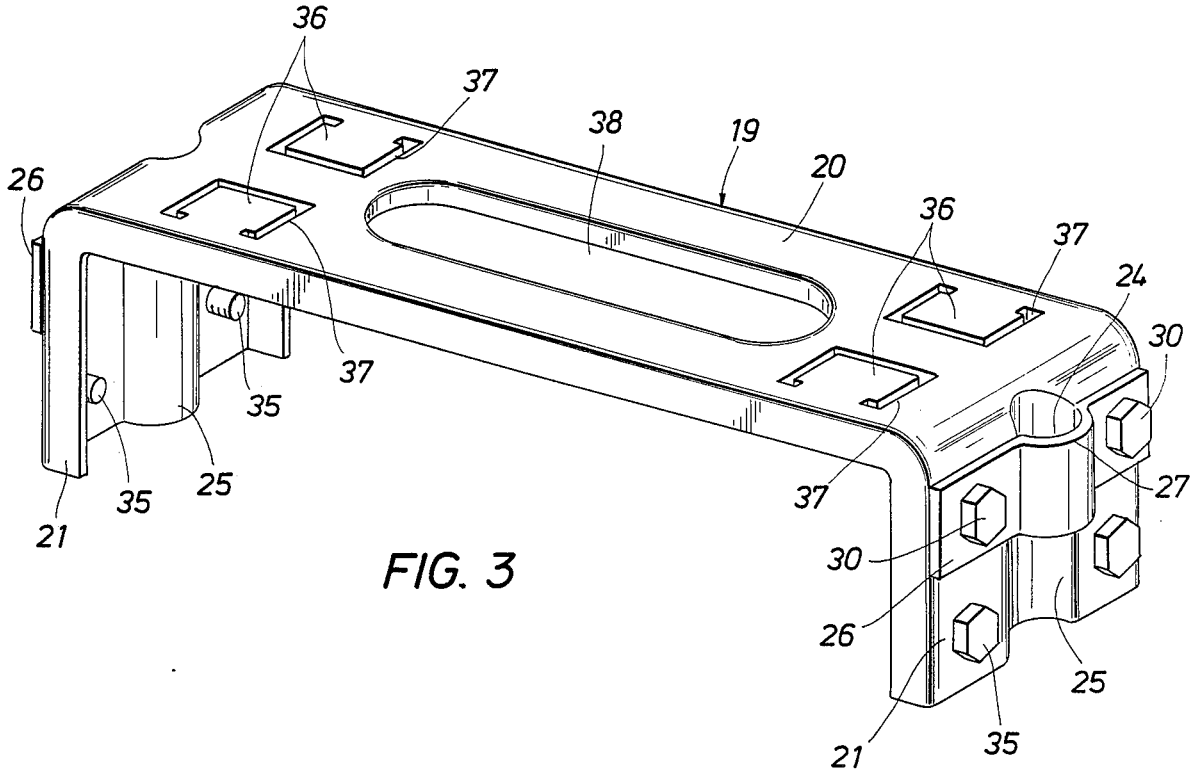
FIGS. 3–6 are close-ups of the strap.

In one preferred embodiment, FIG. 3, the spike attachment means 22 includes an open ended spike pocket or cylinder 24 defined between the strap arm 21 and a spike clip 26 by a spike arm indentation 25 running the length of each strap arm 21 and a spike clip indentation 27. The spike cylinder 24 may be substantially triangular, oval or circular in cross section and is orientated parallel to the strap arm 21 and perpendicular to the strap body 20. Each clip 26 has at least one clip hole 28 defined on each side of the clip indentation 27. Each arm 21 has at least one spike arm threaded hole 29 defined on each side of the spike ar indentation 25. The clip holes 28 and the spike arm holes 29 cooperate so that threaded clip bolts 30 will pass through the clip hole 28 into the spike arm holes 29. The size of the spike cylinder 24 is such that when the clip 26 is loosely attached to the arm 21 the spike 23 will fit into the cylinder 24, and the strap 19 will slide over the spike 23, but when the clip bolts 30 are tightened, the strap 19 will be firmly attached to the spike 23. The clip holes 28 may also be threaded.

Figures 5, 6:
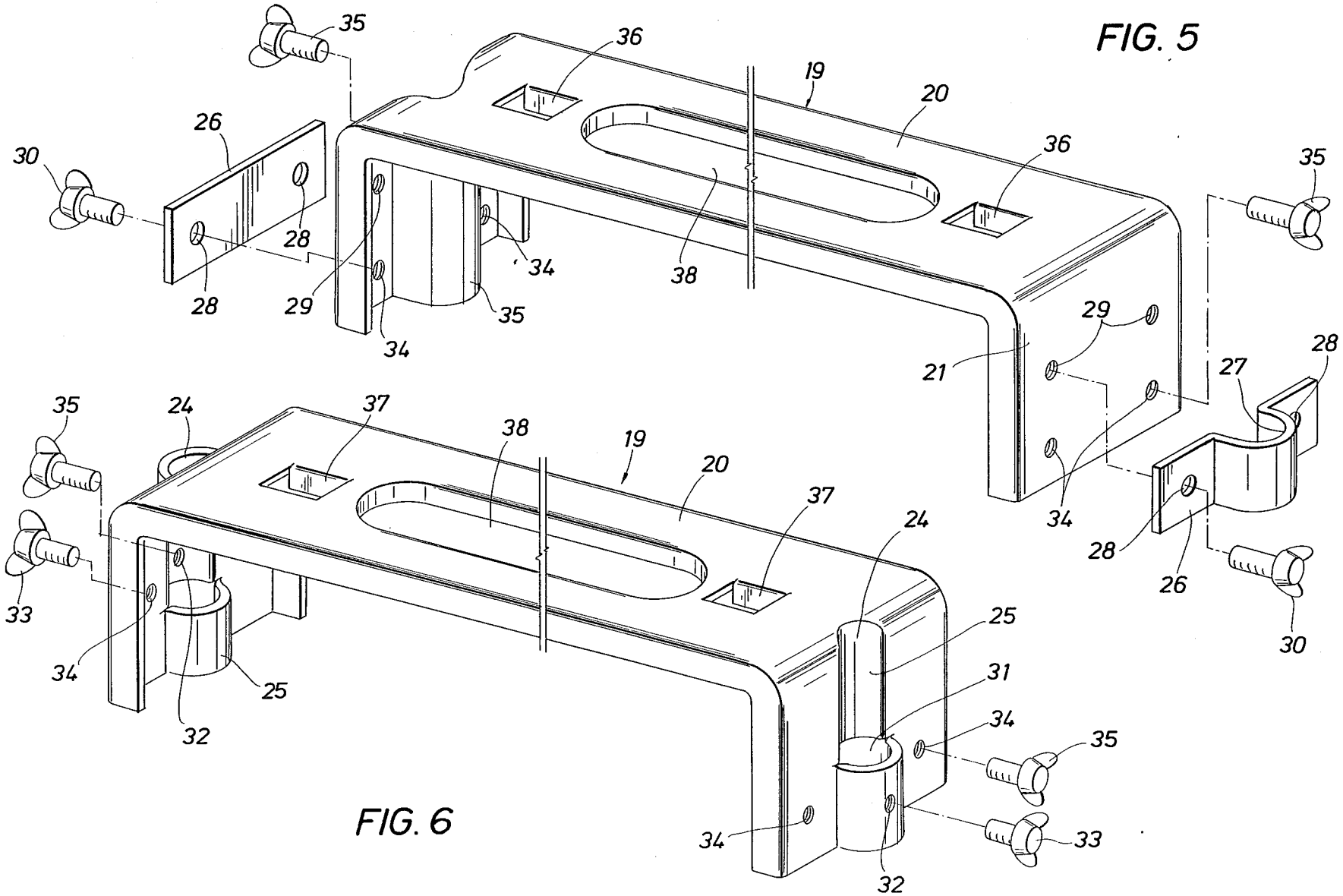

FIG. 5 shows another preferred embodiment of the invention where the open-ended spike cylinder 24 is formed by the arm 21 and the clip 26, but in this embodiment only the clip 26 has an indentation 27 at one end of the strap 19 and only the arm 21 has an indentation 25 at the other end of the strap. Such open-ended pocket or cylinder 24 cross sections have a flat side.

Figure 4:
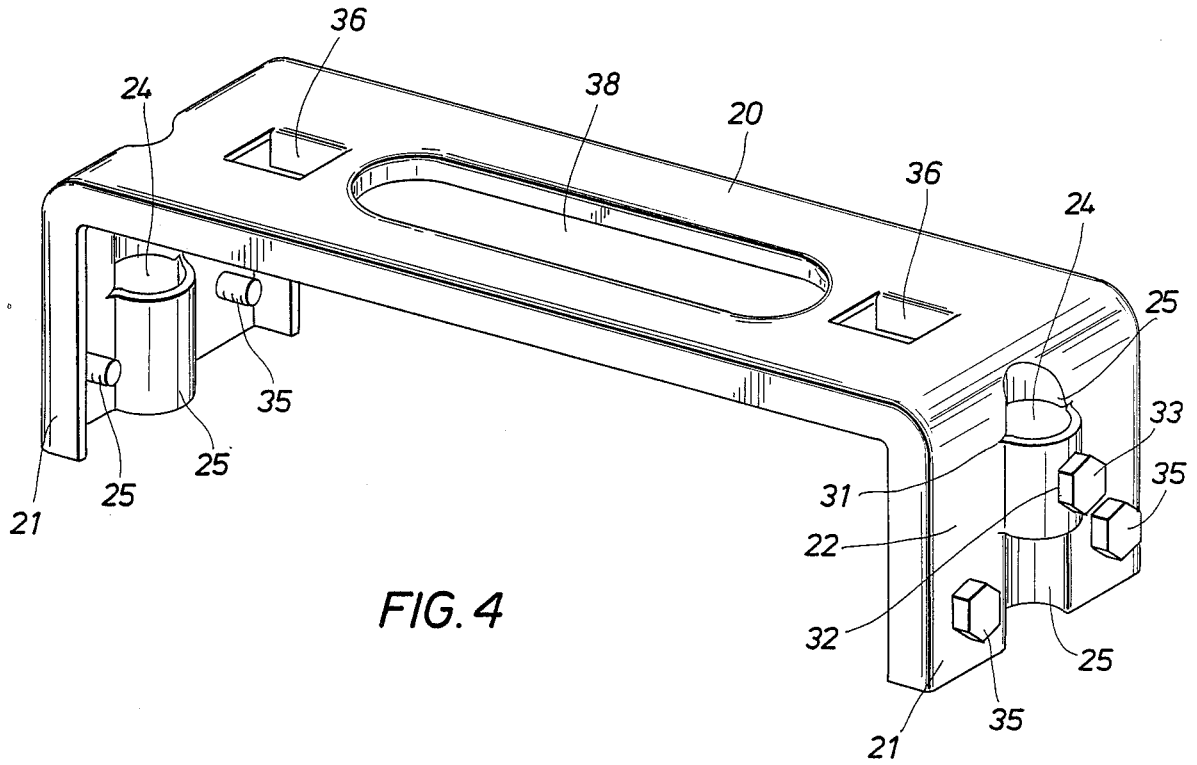

In another preferred embodiment of the invention, illustrated by FIGS. 4 and 6, the spike attachment means 22 includes at least one cut 31 in the strap arm 21 so that part of a cylinder 24 is formed by a spike arm indentation 25 bent toward the inside of the U-shaped strap 19 and a second part is bent to form at least one spike arm counter-indentation 31 bent away from the inside of the U-shaped strap 19. At least one of the counter-indentations on each arm has a counter-indentation threaded hole 32 through which is located in threaded engagement a counter indentation threaded spike lock bolt 33.

The cylinder 24 clearance is large enough to allow the spike 23 to initially slide therein but the strap 19 can be attached to the spike 23 by tightening either the clip bolts 30 o the lock bolt 33. The clip bolt 30 and/or the lock bolt 33 can have any kind of head but wing heads are preferred.

The spike 23 may be any bar or rod, but is preferably a steel reinforcing bar (rebar). The spike 23 may be made to stand vertically by either (1) driving the bottom end 41 into the ground,
(2) attaching the spike 23 to the spike attachment means 22 and the strap 19 to two sections 2 and simply allowing the bottom end 41 to rest on the ground or
(3) attaching the bottom end 41 to a stand means 42 (FIGS. 1 and 7) including a stand spike attachment mean 43 preferably made from base 44 having a spike indentation 45 therein.

Each strap arm 21 has at least two threaded channel holes 34 which cooperate with at least two threaded channel bolts 35. The position of the threaded channel holes 34 o the strap arm 21 is such that when the strap body 20 is placed over the top 10 or under the bottom 7 at the joint between two drainage channel sections 2 at least one threaded channel hole 34 is directly over an alignment anchor indentation 17 of on of the adjoining sections 2 and at least one threaded channel hole 34 is over an alignment anchor indentation 17 of the other adjoining section 2 when the two sections 2 are aligned with each other. The channel indentation bolt 35 is tightened so that its end moves into the alignment anchor indentation 17, thereby forcing alignment of the two channel sections 2 and attaching the strap 19 to the drainage channel section 2. When the alignment anchor indentation 17 has inwardly sloping sides 18, the movement of the channel indentation bolt 35 down into the indentation 17 forces the alignment of the two sections 2.

The strap 19, clip 26 and bolts 32, 33 and 35 may be made of wood, plastic or metal. The preferred material is metal. The preferred metal is steel.

Inserts 39 (FIG. 7) may be used in the alignment anchor indentation 17 to protect the polymer cement. These inserts may be made of wood, metal or plastic. The preferred material is plastic and the preferred plastics are polyethylene and polypropylene. Such plastic inserts also help secure the strap 19 to the section 2.

In a preferred embodiment of the invention, cuts are made in the horizontal section or body 20 of the strap 19 so that at least one set of two spacing ears or tabs 36 may be formed by bending the material. The distance between the outside edge 37 (or side nearest the vertical section 21) of the first tab and the outside edge 37 of the second tab 36 is equal to or slightly less than the distance between the inside surfaces 5 of the sidewalls 4 and 5 and the depth of the tab 36 is such that when the strap 19 placed on top 10 of the section 2 the tabs 36 essentially rest against the inner surface 5 of the walls 3 and 4 of a section 2.

When the strap 19 is placed over the opening 10 at the juncture between two sections 2 it is preferred that one set of tabs 36 contact the inner surface 5 of wall 3 and 4 of one channel section 2 or of both sections 2 (i.e. the least support is obtained when one tab 38 interacts with the inner surface 5 of one wall 3 of one channel section 2 and a second tab 38 interacts with the inner surface 5 of a wall 4 of a second channel section even though the mitered joint gives some cooperation between the wall of section 2). It is also possible to have two sets of tabs 36 (see FIG. 3) so that one set of tabs 36 cooperate with one channel section 2 and another set of tabs 36 cooperate with a second channel section 2.

The strap 19 preferably has a concrete access hole 38 defined through the body 20 to allow concrete to flow between the strap 19 and the section 2 when the strap 19 is used a the bottom 7 of the section 2.

A method of installing a drain channel 1 using this invention involves the steps of digging a trench, placing the numbered drainage channel sections 2 i the trench in the order prescribed approximately in the position in the trench where they will be encased in concrete, attaching at least one alignment/anchor strap 19 to each end of one drainage channel section 2 by placing the strap over the top hole 10 or under the bottom 7 so that the arms 21 extend parallel to the outside surface 6 of the sidewalls 4 and 5 and tighten the channel bolt 35 into the channel indentation 17 so that part of the strap 19 and a channel bolt 35 extend beyond the end of the section 2, slide a spike 23 through each cylinder 24 of the four spike attachment mean 22 and drive them into the bottom of the trench so that the drainage channel section 2 is held below the position that it will be encased in concrete. Raise the drainage channel section 2 to the height in the trench where it is to be encased by sliding it upwardly over the spike 23 and secure the section 2 to the spike 23 with the spike attachment means 22. Place the end 11 of the next (consecutively numbered) section 2 in the strap 19 (under and/or over) tighten the free channel bolt 35 into the indentation 17 of the second section 2 so that the first and second drainage channel sections 2 abut each other and are aligned so that the top of the sidewalls 3 and 4 of the two sections 2 are the same and are at the desired level in the trench and the ends 11 abut each other to give the proper interior slope and seal. Attach a third strap 19 to the free end of the second section 2 by tightening the channel bolt 35 into the indentation 17 on both outer surfaces 6 of the free end of the second section 2, slide two spikes 23 through the cylinders 24 of the spike attachment means 22, drive the spikes 23 into the bottom of the trench, position the free end 11 of the second section 2 at its proper height and secure it to the spikes 23 via the two attachment means 22. This process is continued until each of the sections 2 are raised to its proper height in the trench and secured to its immediate neighbor section 2 or sections 2.

The process of installing and aligning the sections 2 has been described by the sequence of first attaching an installation/alignment strap 19 onto a section 2 followed by sliding a spike 23 into the spike attachment mean two 22. It is considered equivalent to reverse this order, i.e. first slide one two spikes 23 into the spike attachment means 22 and then attach the strap 19 to the section 2. It should also be recognized that it is equivalent to drive the spikes 23 into the ground before sliding the spike 23 into the cylinder 24 or after sliding the spike 23 into the cylinder-like strap clip 24.

When the strap 19 is used across the top 10 of a section 2, the tab or ear 36 is bent so as to have its end nearest the inner surface 5 of the sidewalls 3 and 4 essentially touching the surface 5 in order to prevent the weight of the liquid concrete from distorting the sides 3 and 4 so that the top hole 10 is too small to receive the grids or grates 40.

The concrete may be poured into the trench in one or more stages. If the concrete is to be poured in one stage, i.e. the concrete is poured until it is essentially at the top of the sidewalls 3 and 4, straps 19 are attached to the drainage channel sections 2 only at the bottom 7. If the concrete is going to be poured into the trench in at least two stages (the first stage fixing the sections in their position in the trench), straps 19 ma be connected only to the bottom 7 only to the top 10 or to the top 10 and bottom 7 of the section 2. Once the first stage of concrete has set, the straps 19 are removed from the top 10 by loosening the bolts 30 or 33 and 35 in the alignment anchor indentations 17 and the spike attachment means 22 until the straps 19 can be removed. If the spikes extend above the planned final surface of the second stage addition of concrete, they may be bent so as to be below the level of the final stage of concrete addition and the second or final stage of concrete added. The tab 36 can be bent (with a hammer and screw driver or pliers) in a direction opposite to the arms 21, the strap 19 placed on top of the sidewalls 3 and 4 so that the tabs essentially touch each inner surface 5 of the sidewalls 3 and 4 preventing distortion but so that the strap arms 21 point away from the trench and are not encased in the concrete. The latter mode of using the tabs 36 of the strap 19 is usually only used when the strap 19 is used t maintain a gauged distance between the walls.

Many times, when these drainage channels 1 are installed, the grids are wrapped in a material such as paper or cloth or plastic and the grids placed over the opening 10 in order to prevent concrete from inadvertently being introduced into the drain channel. The clearance between the strap 19 and the top 10 is such that the grids 40 and the strap 19 do not interfere with each other. Tab 36 of FIG. 5 is placed so as to fit between the inner surface 5 and the grid so that the combination of the tab 6 and the grid 40 prevent distortion of the opening 10.

The greatest number of straps 19 required for a line of drainage channel sections 2 when only one strap 19 is used per end 11 of section 2 is one more than the number of sections.

The number of alignment/anchor indentations 17 on the outside surface 6 of a drainage channel section 2 may vary from between 4 and 12, i.e. between 1 and 3 on each wall 3 and 4 at each end 11.

We claim as our invention:

1. A strap for installing and aligning a drainage channel comprised of two or more drainage channel sections locatable in a trench, each drainage channel section having spaced-apart walls with inner and outer wall surfaces, a bottom with inner and outer wall surfaces, the inner wall and bottom surfaces forming a U-shaped channel with a top opening and at least one end opening, the end opening of a first section made so as to operatively engage with the end opening of a second section and each channel section having at least one alignment anchor indentation on the outside surface of each wall near the end opening, wherein said strap comprises a body with two arms attached to the body, the combination of the body and the arms essentially forming a U, the distance between the arms being slightly larger than the distance between the outside surface of the drainage channel walls, each arm having a spike attachment means for accepting, sliding over and attaching to a spike and at least two threaded channel holes with channel indentation bolts therein, the threaded channel holes being positioned on the arm so that when the strap is placed over the channel top opening or under the channel bottom at the joint between two drainage channel sections, with the arms extending over the outer surface of the channel walls, at least one threaded channel hole is positioned over the alignment anchor indentation of the first channel section and at least a second threaded channel hole is positioned over the alignment anchor indentation of the second channel section when the two channel section end openings are joined and aligned.

2. The strap of claim 1 wherein the body has concrete access hole to allow concrete to flow between the strap and the channel sections.

3. The strap of claim 1 wherein the spike attachment means comprises an open-ended spike cylinder formed from the combination of the arm and a spike clip, the combination having at least one indentation parallel to the arm and perpendicular to the body, the spike clip having at least two clip holes, one on either side of the spike clip indentation and the arm having at least two threaded spike arm holes, one on either side of the indentation placed so as to cooperate with the spike clip holes and at least two threaded clip bolts which pass through said clip holes and screw into said threaded spike arm holes to allow adjustment of the diameter of the open ended spike cylinder.

4. The strap of claim 1 wherein the spike attachment means comprises a spike cylinder formed by at least one cut in the arm and at least one spike arm concave indentation relative to the U-shape of the strap and at least one spike arm counter-indentation relative to the U-shape of the strap, the combination of the indentations running the length of the arm, perpendicular to the body and at least one threaded hole in at least one counter-indentation with a threaded spike lock bolt in the threaded hole to secure the strap to the spike.

5. The strap of claim 1 wherein the body includes first tab adjacent one arm of the strap and a second tab adjacent the second arm of the strap, both tabs projecting perpendicular to the body in the same direction as the arms, the placement of the tabs and the length of the tabs being such that when the strap is placed over the top opening and the channel indentation bolts screwed into the alignment anchor indentations, the edge of one tab nearest its respective arm is essentially touching the inner surface of first wall of the channel section and the edge of the second tab nearest its respective arm i essentially touching the inner surface of the second wall of the channel section.

6. In drainage channel section used to form a drainage channel run having a predetermined slope where the run is comprised of two or more drainage channel sections in a trench and the drainage channel section is comprised of two spaced-apart walls with inner and outer wall surfaces, a bottom with inner and outer wall surfaces, the inner wall and bottom surfaces forming a U-shaped channel with a top opening and at least one end opening, the end opening of a first section made so as to operatively engage with the end opening of a second section the improvement which comprises drainage channel sections having at least one alignment anchor indentation on the outside surface of each wall near the end opening, placed so as to cooperate with an alignment anchor strap which comprises a body with two arms attached to the body the combination of the body and the arms essentially forming a U, the distance between the arms being slightly larger than the distance between the outside surface of the drainage channel walls, each arm having a spike attachment means for accepting, sliding over and attaching to a spike and at least two threaded channel holes with at least two channel indentation bolts therein, the threaded channel holes being positioned on the ar so that when the strap is placed over the channel top opening or under the channel bottom at the joint between two drainage channel sections with the arms extending over the outer surface of the channel walls, at least one threaded channel hole is positioned over at least one of the alignment anchor indentations of the first channel section and at least a second threaded channel hole is positioned over the alignment anchor indentation of the second channel section when two channel sections end openings are joined and aligned.

7. The drainage channel sections of claim 6 wherein the alignment anchor indentations have inwardly sloping walls.

8. The drainage channel sections of claims 6 and further including a plastic insert carried by the alignment anchor indentations.

9. A combination of the strap of claim 1, the drainage channel section of claim 6 and two spikes for cooperating with the spike attachment means of the strap, wherein the strap is connected to the drainage channel sections by screwing the channel indentation bolts into the alignment anchor indentations on each channel wall and the spikes are inserted into the spike attachment means of each arm of the straps.

10. The combination of claim 9 where the spike further comprises a rebar.

* * * * *